US005918744A

United States Patent [19]

Bringard et al.

[11] Patent Number: 5,918,744

[45] Date of Patent: Jul. 6, 1999

[54] SHIPPING CONTAINER SYSTEM AND METHOD OF CONSTRUCTING THE SAME

[75] Inventors: Timothy L. Bringard, Grosse Ile; Buddy E. Giebel, Monroe, both of Mich.

[73] Assignee: Ace Packaging Systems, Inc., Monroe, Mich.

[21] Appl. No.: 09/006,913

[22] Filed: Jan. 13, 1998

[51] Int. Cl.[6] ..... B65D 19/20

[52] U.S. Cl. ..... 206/596; 108/51.3; 206/598

[58] Field of Search ..... 206/386, 598, 206/599, 600, 596; 108/51.3, 56.1, 56.3

[56] References Cited

U.S. PATENT DOCUMENTS

| | | | |
|---|---|---|---|
| 3,442,434 | 5/1969 | De Simas | 206/598 |
| 3,480,196 | 11/1969 | De Simas | 206/598 |
| 3,568,912 | 3/1971 | De Simas | 206/598 |
| 3,730,417 | 5/1973 | Lawson | 206/598 |
| 3,995,736 | 12/1976 | Lawson et al. | 206/596 |
| 4,085,846 | 4/1978 | Williams . | |
| 4,091,923 | 5/1978 | Collins . | |
| 4,712,687 | 12/1987 | Silcott et al. . | |
| 4,863,024 | 9/1989 | Booth . | |
| 4,898,321 | 2/1990 | Delany | 206/599 |
| 4,976,353 | 12/1990 | Halliday . | |
| 5,004,102 | 4/1991 | Timmins et al. . | |
| 5,069,338 | 12/1991 | Grigsby . | |
| 5,163,555 | 11/1992 | West et al. . | |
| 5,318,219 | 6/1994 | Smith . | |
| 5,350,066 | 9/1994 | Mendoza et al. . | |
| 5,370,233 | 12/1994 | Schutz et al. . | |
| 5,413,216 | 5/1995 | Timmins . | |
| 5,441,154 | 8/1995 | Youell, III . | |
| 5,595,304 | 1/1997 | Timmins | 206/598 |
| 5,704,487 | 1/1998 | Taravella et al. | 206/596 |
| 5,794,542 | 8/1998 | Besaw | 108/51.3 |

*Primary Examiner*—Bryon P. Gehman
*Attorney, Agent, or Firm*—Brinks Hofer Gilson & Lione

[57] ABSTRACT

A shipping container system and method of construction therefor are provided which includes a container with an integrated pallet assembly. The system includes an inner shell, an outer shell, a cover assembly, and a pallet assembly. The outer shell is formed from a single sheet of material, preferably high strength cardboard and is cut and bent such that four panels are created, each having a flap. The outer shell also has several holes located in the panels. The inner shell is formed in a similar manner, also having four panels, each with a flap. The pallet assembly includes a floor panel supported by several runners having notches. To assemble the shipping container system, the inner shell is placed within the upper portion of the outer shell and the pallet assembly is inserted into the lower portion of the outer shell. The outer shell panel flaps are then folded to provide support for the pallet assembly from underneath. The panel flaps of the inner shell are folded within the inner shell to provide support for the pallet assembly from above. So assembled, the pallet assembly is securely positioned between the flaps of the outer shell and the flaps of the inner shell. The system further includes that the holes in the outer shell panels align with the notches of the pallet assembly runners to allow the tines of a forklift or jack truck to engage the shipping container system.

15 Claims, 2 Drawing Sheets

SHIPPING CONTAINER SYSTEM AND METHOD OF CONSTRUCTING THE SAME

FIELD OF THE INVENTION

The present invention relates to a shipping container system and the method of constructing it; more specifically, to a container and method which utilizes an integrated pallet assembly to provide stability during transportation of goods using a forklift or jack truck.

BACKGROUND

Containers placed upon pallets are commonly used to transport a multitude of goods. Forklifts or jack trucks are used to move the pallets and containers and it is therefore necessary that the containers fit squarely on the pallets and remain in position during transportation. A typical arrangement includes a corrugated cardboard container which is placed atop a standard wooden pallet which is then moved about a warehouse, shipping dock, or other like facility.

Conventional wooden pallets are strong and easily stacked, but can be the source of a variety of problems. They are heavy, relatively expensive, and difficult to transport or recycle after use. Furthermore, cartons which are stacked upon but not fastened to the pallets in some way have a tendency to slide around on top of the pallet, thereby causing a forklift or jack truck operator to waste valuable time in rearranging the cartons. In the extreme case, the cartons may actually fall off the pallet, potentially causing damage to or destruction of the goods being transported.

SUMMARY

To overcome the above-mentioned problems, a shipping container system for transportation of goods and method of construction is provided which includes an integrated pallet assembly. The system includes an timer shell, an outer shell, a cover assembly, and a pallet assembly positioned between flaps of the inner and outer shells.

The inner and outer shells of the preferred embodiment are each formed from a single sheet of high strength cardboard or like material. The sheet of material is bent to from a front, rear, left, and right panel. Each panel of both the inner and outer shells is cut to form a flap. The outer shell has several holes located in the panels. The pallet assembly includes a sheet of material supported by several support members or runners. The runners define channels between each other and also have several notches cut along their lengths.

To assemble the shipping container system, the inner shell is placed within the outer shell and the pallet assembly is inserted into the lower portion of the outer shell. The outer shell flaps are then folded to support the pallet assembly from underneath. The outer shell flaps may be fastened to each other or to the bottom surface of the pallet assembly. The flaps of the inner shell are folded within the inner shell to support the pallet assembly from above. Similarly, the inner shell flaps man be fastened to each other or to the upper surface of the pallet assembly. So assembled, the pallet assembly is held securely in place between the flaps of the outer shell and the flaps of the inner shell. The system further includes the pallet assembly being disposed within the outer shell such that the holes in the outer shell align with the notches and channels of the pallet assembly runners to allow the tines of a forklift or jack truck to engage them, thereby permitting safe and stable transportation of the goods within the shipping container system.

It is therefore an object of the present invention to provide a high-quality shipping container system and method of construction which is lightweight, inexpensive, and stable during transportation.

It is further an object of the present invention to provide a shipping container system and method of construction which utilizes a shipping carton with an integrated pallet assembly.

It is still further an object of the present invention to provide a shipping container system and method of construction where the pallet assembly is supported and reinforced by the shipping carton.

Additional advantages and features of the present invention will become apparent from reading the detailed description of the preferred embodiments which make reference to the following set of drawings.

DETAILED DESCRIPTION

Figure 1:
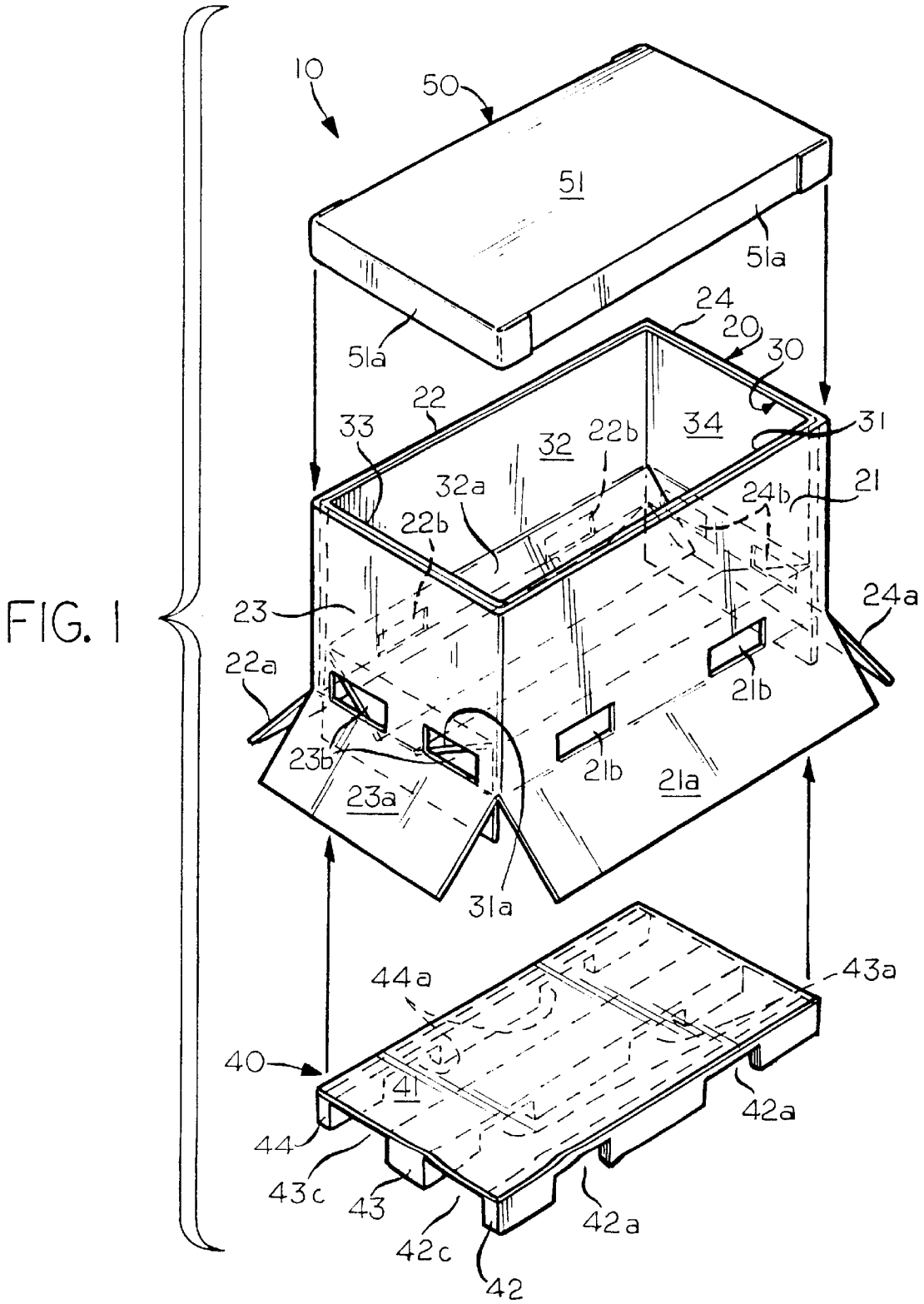
FIG. 1 shows an exploded perspective view of the present invention.
Figure 2:
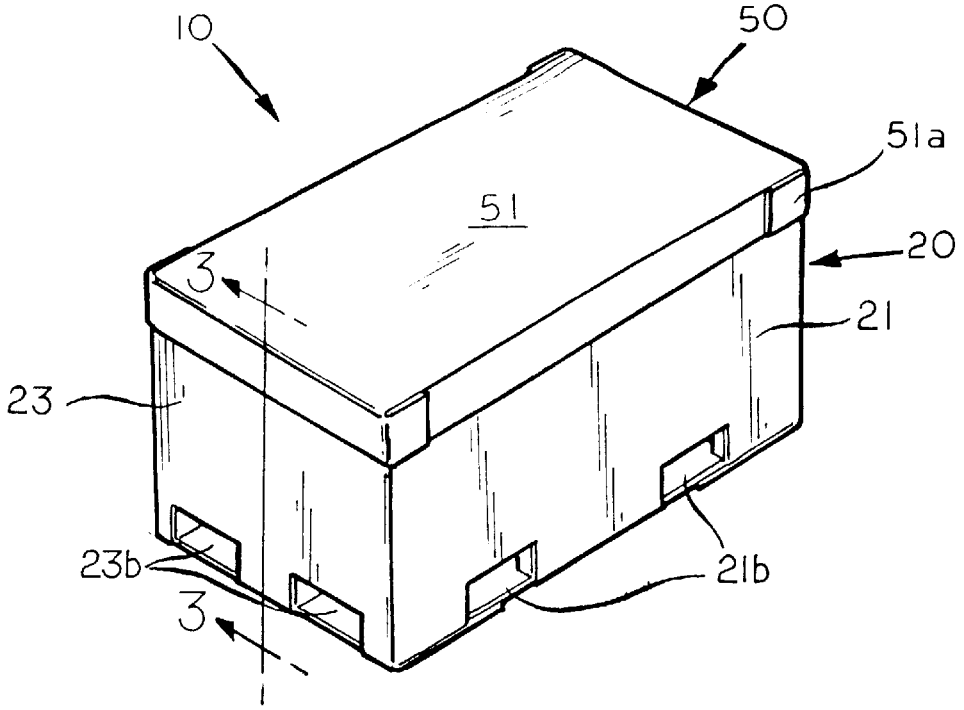
FIG. 2 shows a perspective view of the assembled invention.
Figure 3:
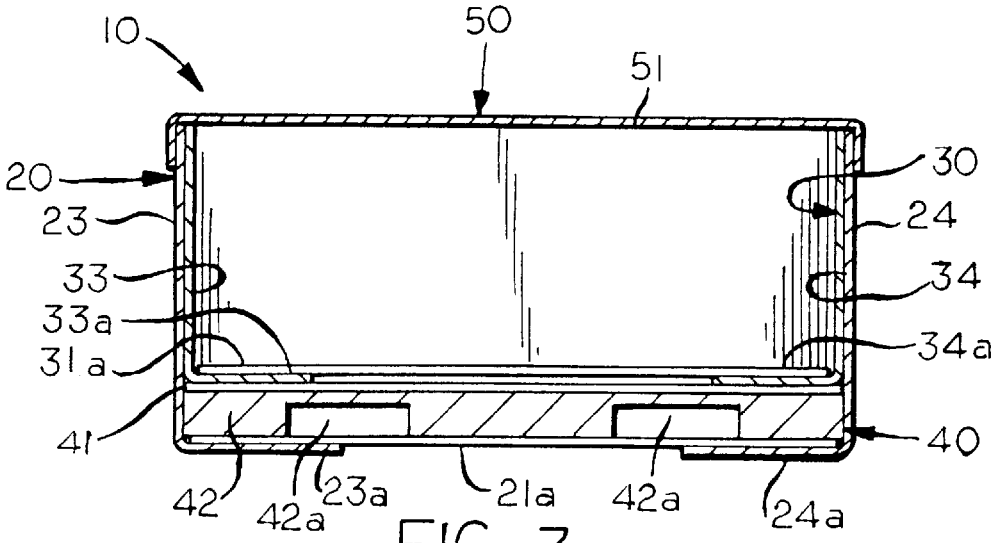
FIG. 3 shots s a sectional view taken along the line 3—3 of FIG 2.

Referring now to FIGS. 1–3, a shipping container system is provided which is generally referred to by the reference numeral 10. The shipping container system 10 includes an outer shell 20, an inner shell 30, a pallet assembly 40, and a cover assembly 50, to be described further herein.

With respect to the orientation shown in FIGS. 1 and 2, the outer shell 20 has a generally rectangular horizontal cross section and includes a front panel 21, a rear panel 22. A left side panel 23, and a right side panel 24. Each of the panels 21–24 of the outer shell 20 in turn includes a corresponding flap; that is, the front panel 21 includes a flap 21*a*, the rear panel 22 includes a flap 22*a*, the left side panel 23 includes a flap 23*a*, and the right side panel 24 includes a flap 24*a*. Each of the panels 21–24 also contains holes 21*b*–24*b*, respectively. The outer shell 20 of the preferred embodiment is constructed of a single sheet of corrugated cardboard, plastic, or any other material with suitable structural and load bearing qualities which is cut and bent to form the flaps 21*a*–24*a* and the holes 21*b*–24*b*.

The configuration of the inner shell 30 is similar to that of the outer shell 20. The inner shell 31 also has a rectangular horizontal cross section and includes a front panel 31, a real panel 32, a left side panel 33, and a right side panel 34. Each of the panels 31–34 of the inner shell 30 also includes a corresponding flap, that is, the front panel 31 includes a flap 31*a*, the rear panel 32 includes a flap 32*a*. The left side panel 33 includes a flap 33*a*, and the right side panel 34 includes a flap 34*a*. However, there are no holes in the inner shell 30 which correspond to those in the outer shell 20. Like the outer shell 20, the inner shell 30 is also constructed of such sheet of cardboard, plastic, or the like, and then cut and benefit to foil the flaps 31*a*–34*a*. The inner shell 30 is constructed such that its outer dimensions are slightly smaller than the inner dimensions of the outer shell 20 so that the inner shell 30 can fit tightly within the outer shell 20, as shown in FIGS. 1 and 3. Furthermore, the inner shell 30 is slightly shorter in the vertical direction than the outer shell 20 (the difference between the height of the outer shell 20 and the inner shell 30 is about the same as the height of the pallet assembly 40).

The pallet assembly 40 of the preferred embodiment includes a floor panel 41, a front runner 42 a center runner 43, and a rear runner 44. The floor panel 41 and runners 42–44 inlay be constructed of a material similar or identical to that used to construct the enter shell 20 or the inner shell 30. The runners 42–44 are elongate and are attached to the underside of the floor panel 41 using glue, nails, screws, or the like and extend the length of the floor panel 41 to provide structural support. Alternatively, the runners 42–44 may formed as an integral part of the floor panel 41. The front runner 42 also includes notches 42*a*, the center runner 43 and the rear runner 44 contain similar notches 43*a* and 44*a*, respectively (shown in phantom in FIG. 1). Notches 42*a*–44*a* are aligned to allow the tines of a forklift or jack truck to engage the pallet assembly 40. The front runner 42 and center runnier 43 define a channel 42*c* between the two. Similarly, the center runner 43 and the rear runner 44 define a channel 43*c* between the two. The channels 42*c* and 43*c* allow forklift access from either side of the shipping container system 10. The outer dimensions of the pallet assembly 40 are substantially identical to those of the inner shell 30 so that the pallet assembly 40 can fit tightly within the lower portion of the outer shell 20.

The final component of the shipping container system 10 is a cover assembly 50. The cover assembly 50 includes a top panel 51 which has four flaps 51*a*, as shown in FIGS. 1 and 3. The cover assembly 50 of the preferred embodiment is also constructed of a single sheet of material such as cardboard or plastic. The top panel 51 is then cut and bent appropriately to form the flaps 51*a* which are secured to each other as shown using glue, staples, or like fastening means. The cover assembly 50 is constructed such that its inner dimensions are slightly larger than the outer dimensions of the outer shell 20 so that the cover assembly 50 will fit tightly around the upper portion of the outer shell assembly 20, thus forming a lid.

The final assembled configuration of the preferred embodiment of the shipping container system 10 is as follows, best shown in FIG. 1. The pallet assembly 40 is positioned inside the lower portion of the outer shell 20 such that the bottom of the outer shell 20 and the bottom of the pallet assembly 40 are generally aligned. The outer shell flaps 21*a*–24*a* are folded such that they provide support for the pallet assembly 40 from underneath, best shown in FIG. 3. The sequence of folding the flaps 21*a*–24*a* is unimportant and may be varied without affecting the structural integrity of the shipping container system 10. The flaps 21*a*–24*a* are then fastened to each other or to the lower surfaces of the runners 42–44 using glue, staples, or the like. Furthermore, the holes 21*b* and 22*b* of the outer shell 20 align with the corresponding notches 42*a*–44*a*. Similarly, the holes 23*b* and 24*b* of the outer shell 20 align with the channels 42*c* and 43*c*, shown best in FIG. 2, which allows the tines of a forklift to engage the shipping container system 10 for transportation.

After the pallet assembly 40 is correctly positioned inside the outer shell 20, the inner shell 30 is positioned within the upper portion of the outer shell 20, as shown in FIG. 1. The flaps 31*a*–34*a* of the inner shell 30 are folded down such that the pallet assembly 40 is secured between the flaps 21*a*–24*a* of the outer shell 20 and the flaps 31*a*–34*a* of the inner shell 30. Again, the sequence of folding the flaps 31*a*–234*a* is not important as long as all four flaps 31*a*–34*a* form a relatively flat surface to provide support to the pallet assembly 40 from above. The flaps 31*a*–34*a* of the inner shell 30 may be then fastened to each other or to the upper surface of the floor panel 41 using glue, staples, or an equivalent means. Alternatively, the inner shell 30 may be positioned within the upper portion of the outer shell 20 prior to positioning the pallet assembly 40 inside the lower portion of the outer shell 20.

With the shipping container system 10 correctly assembled, it is ready to receive goods. When the shipping container system 10 is filled to the desired capacity, the cover assembly 50 may be placed over the open top portion to prevent spillage during transportation.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed:

1. A shipping container system, said system comprising:

an outer shell, said outer shell having a front wall, a back wall, a first side wall, and a second side wall wherein said front wall is opposite said back wall and said first side wall is opposite said second side wall;

an inner shell, said inner shell having a front wall, a back wall, a first side wall, and a second side wall wherein said front wall is opposite said back wall and said first side wall is opposite said second side wall, said inner shell being disposed within said outer shell;

a pallet assembly, said pallet assembly comprising a floor panel and at least two support members being positioned on the underside of said floor panel, said pallet assembly being positioned within a lower portion of said outer shell, said front wall, said back wall, said first side wall and said second side wall of said outer shell each have a flap hingedly attached thereto, and said front wall, said back wall, said first side wall and said second side wall of said inner shell each have a flap hingedly attached thereto.

2. The system according to claim 1 wherein said flaps of said outer shell are folded and positioned adjacent to said support members of said pallet assembly.

3. The system according to claim 1 wherein said flaps of said inner shell are folded within said inner shell and positioned adjacent to said floor panel of said pallet assembly.

4. The system according to claim 3 wherein said outer shell further comprises a plurality of holes, said plurality of holes being located in said front wall, said back wall, said first side wall and said second side wall of said outer shell.

5. The system according claim 4 wherein said pallet assembly further comprises a plurality of notches being located in said support members.

6. The system according to claim 5 wherein said plurality of holes in said outer shell align with said plurality of notches in said pallet assembly.

7. A shipping container, said container comprising: an outer shell;

an inner shell, said inner shell being disposed within an upper portion of said outer shell;

a pallet assembly, said pallet assembly positioned within a lower portion of said outer shell;

a cover assembly, said cover assembly being fitted over the upper portion of said outer shell, wherein said outer shell comprises four panels being arranged in a box configuration, each panel having a flap being hingedly attached thereto and also having a corresponding hole disposed therein, said inner shell comprising four panels being arranged in a box configuration, each panel having a flap hingedly attached thereto.

8. The container according to claim 7 wherein said pallet assembly comprises:

a floor panel, said floor panel comprising a sheet of generally rigid material having a top surface and a bottom surface; and a plurality of runners, said plurality of runners extending from the bottom surface of said floor panel, each runner having a plurality of notches disposed therein.

9. The container according to claim 8 wherein said holes in said side panels of said outer shell align with said notches in said runners of said pallet assembly.

10. The container according to claim 7 wherein said flaps of said outer shell are folded to provide a surface to support said pallet assembly.

11. The container according to claim 7 wherein said flaps of said inner shell are folded to provide a surface to support said pallet assembly.

12. The container according to claim 7 wherein said pallet assembly is positioned between said flaps of said outer shell and said flaps of said inner shell.

13. A method of constructing a shipping container system, said shipping container system comprising an outer shell having four panels, an inner shell having four panels, each panel having a flap hingedly attached thereto, a pallet assembly having a floor panel and at least two runners, and a cover, said method comprising the steps of:

a) inserting said inner shell into an upper portion of said outer shell;

b) inserting said pallet assembly into a lower portion of said outer shell;

c) folding said flaps of said outer shell to provide support to said pallet assembly from below;

d) folding said flaps of said inner shell to provide support to said pallet assembly from above.

14. The method according to claim 13 further comprising the step of aligning a plurality of holes in said outer shell with a plurality of notches in said runners of said pallet assembly.

15. The method according to claim 13 further comprising the step of positioning said cover on said shipping container.

* * * * *